US005836857A

United States Patent [19]

Jennings

[11] Patent Number: 5,836,857

[45] Date of Patent: Nov. 17, 1998

[54] APPARATUS AND METHOD FOR APPLYING LATERAL FORCE TO BODY JOINTS

[75] Inventor: Fred C. Jennings, P.O. Box 295, Corona del Mar, Calif. 92625

[73] Assignee: Fred C. Jennings, Corona del Mar, Calif.

[21] Appl. No.: 905,786

[22] Filed: Jul. 28, 1997

[51] Int. Cl.[6] ..... A63B 21/00

[52] U.S. Cl. ..... 482/92; 482/79; 482/91

[58] Field of Search ..... 601/27, 23, 33; 482/91, 92, 94, 110, 129, 131, 134, 139, 79, 904

[56] References Cited

U.S. PATENT DOCUMENTS

| | | | |
|---|---|---|---|
| 906,763 | 12/1908 | Winship | 482/91 |
| 2,340,666 | 2/1944 | Johanson | 482/91 |
| 4,010,744 | 3/1977 | Boyen . | |
| 4,181,125 | 1/1980 | Carlson et al. . | |
| 4,277,062 | 7/1981 | Lawrence . | |
| 4,322,072 | 3/1982 | White . | |
| 4,489,935 | 12/1984 | Lusk . | |
| 4,684,122 | 8/1987 | Desmond et al. . | |
| 4,815,731 | 3/1989 | Suarez et al. . | |
| 4,949,957 | 8/1990 | Cucchiara . | |
| 5,186,698 | 2/1993 | Mason et al. | 482/92 |
| 5,244,441 | 9/1993 | Dempster et al. . | |
| 5,258,017 | 11/1993 | Myers et al. . | |
| 5,290,219 | 3/1994 | Hetrick . | |
| 5,303,716 | 4/1994 | Mason et al. . | |
| 5,387,186 | 2/1995 | Edland . | |
| 5,556,369 | 9/1996 | Roberts | 482/131 |
| 5,595,559 | 1/1997 | Viel | 482/91 |

*Primary Examiner*—Michael Buiz
*Assistant Examiner*—Julian W. Woo
*Attorney, Agent, or Firm*—Knobbe, Martens, Olson & Bear, LLP

[57] ABSTRACT

An apparatus and a method apply lateral force to the joints of a leg of a person. The apparatus includes a generally inelastic interconnecting medium having a first end and a second end. A cuff is attached to the first end of the interconnecting medium. The cuff is sized to receive a portion of a foot of the leg to which the lateral force is to be applied. An engager is connected at the second end of the interconnecting medium to attach the interconnecting medium to a substantially stationary object. When the person pulls on the foot in the cuff in a direction away from the substantially stationary object, the foot remains substantially in one location, and a bending moment or a lateral force is applied to the joints of the leg to provide therapeutic relief to the leg joints without requiring the assistance of another person.

17 Claims, 3 Drawing Sheets

APPARATUS AND METHOD FOR APPLYING LATERAL FORCE TO BODY JOINTS

BACKGROUND OF THE INVENTION

1. Field of the Invention

The present invention is in the field of devices and methods for applying lateral force to body joints to provide relief from pain and soreness caused by stiff body joints.

2. Description of the Related Art

One of the side effects of aging as well as one of the side effects of participating in strenuous activities is stiffness in certain joints of the body, particularly of the hips and knees. Such stiffness frequently causes pain and discomfort in the joint areas and can be sufficient to cause debilitation. Often, such stiffness can be temporarily relieved by manipulation of the joints by a chiropractor, a physical therapist, or another person; however, many people, particularly people who live alone, do not have ready access to professional or lay assistance on a daily basis and are compelled to endure the stiffness and the resulting decreased mobility.

SUMMARY OF THE INVENTION

Applicant has discovered a simple apparatus and a method which allow a person to manipulate the knee and hip joints of his or her legs without assistance from another person. The apparatus and the method are safe and are readily implemented so that the apparatus and the method can be used on a daily basis, or even multiple times per day, in order to provide relief from the stiffness in the joints and from the associated pain and decreased mobility.

One aspect of the present invention is an apparatus for applying lateral force to the joints of a leg of a person. The apparatus comprises a generally inelastic interconnecting medium having a first end and a second end. A cuff is attached to the first end of the interconnecting medium. The cuff is sized to receive a portion of a foot of the leg to which the lateral force is to be applied. An engager is connected at the second end of the interconnecting medium to attach the interconnecting medium to a substantially stationary object. When the person pulls on the foot in the cuff in a direction away from the substantially stationary object, the foot remains substantially in one location and lateral force is applied to the joints of the leg. In preferred embodiments, the cuff comprises a soft pliable material to distribute force over the surface of the foot directed away from the interconnecting medium. In one particular embodiment, the cuff comprises a cloth backing material with a cushioned inner liner. In one embodiment, the interconnecting medium is a substantially inelastic cord and the engager comprises a loop formed in the cord. The stationary object, for example, is advantageously a heavy article of furniture. Alternatively, the stationary object is a structure having a connector fixed thereon to engage the interconnecting medium.

Another aspect of the present invention is an apparatus for applying lateral force to the joints of a leg of a person. The apparatus comprises a cuff sized to receive a portion of a person's foot between the toes of the foot and the ankle of the foot. The apparatus further comprises means for interconnecting the cuff to a substantially stationary anchor such that when the foot of one leg of the person is placed in the cuff and the person pulls away from the anchor, the foot is constrained from moving, thereby applying lateral force to the knee and hip joints of the one leg. Preferably, the cuff comprises a soft pliable material to distribute force over the surface of the foot directed away from the means for interconnecting. In one particular embodiment, the cuff comprises a cloth backing material with a cushioned inner liner. In one embodiment, the means for interconnecting comprises a substantially inelastic cord having a loop formed in at least one end to engage the anchor. The anchor advantageously comprises a heavy article of furniture. Alternatively, the anchor comprises a structure having a connector fixed thereto for attaching to the means for interconnecting.

A still further aspect of the present invention is a method for applying lateral force to the joints of a leg of a person. The method comprises the step of inserting the foot of the leg into a cuff anchored to a substantially stationary object at a level proximate to a surface on which the person is standing. The method comprises the further step of leaning the person's body in a direction away from the substantially stationary object to pull on the foot in the cuff to cause a pulling force applied to the foot to be transmitted to the joints of the leg, thereby applying lateral force to the joints. Preferably, the leg having the foot in the cuff is relaxed so that the pulling force applied to the foot is transmitted to the joints and is not substantially counteracted by the muscles and tendons of the leg. In one embodiment in accordance with the method, the stationary object comprises a heavy article of furniture. Alternative, the stationary object comprises a structure.

BRIEF DESCRIPTION OF THE DRAWINGS

The present invention will be described below in connection with the accompanying drawing figures in which.

DETAILED DESCRIPTION OF THE PREFERRED EMBODIMENT

Figure 1:
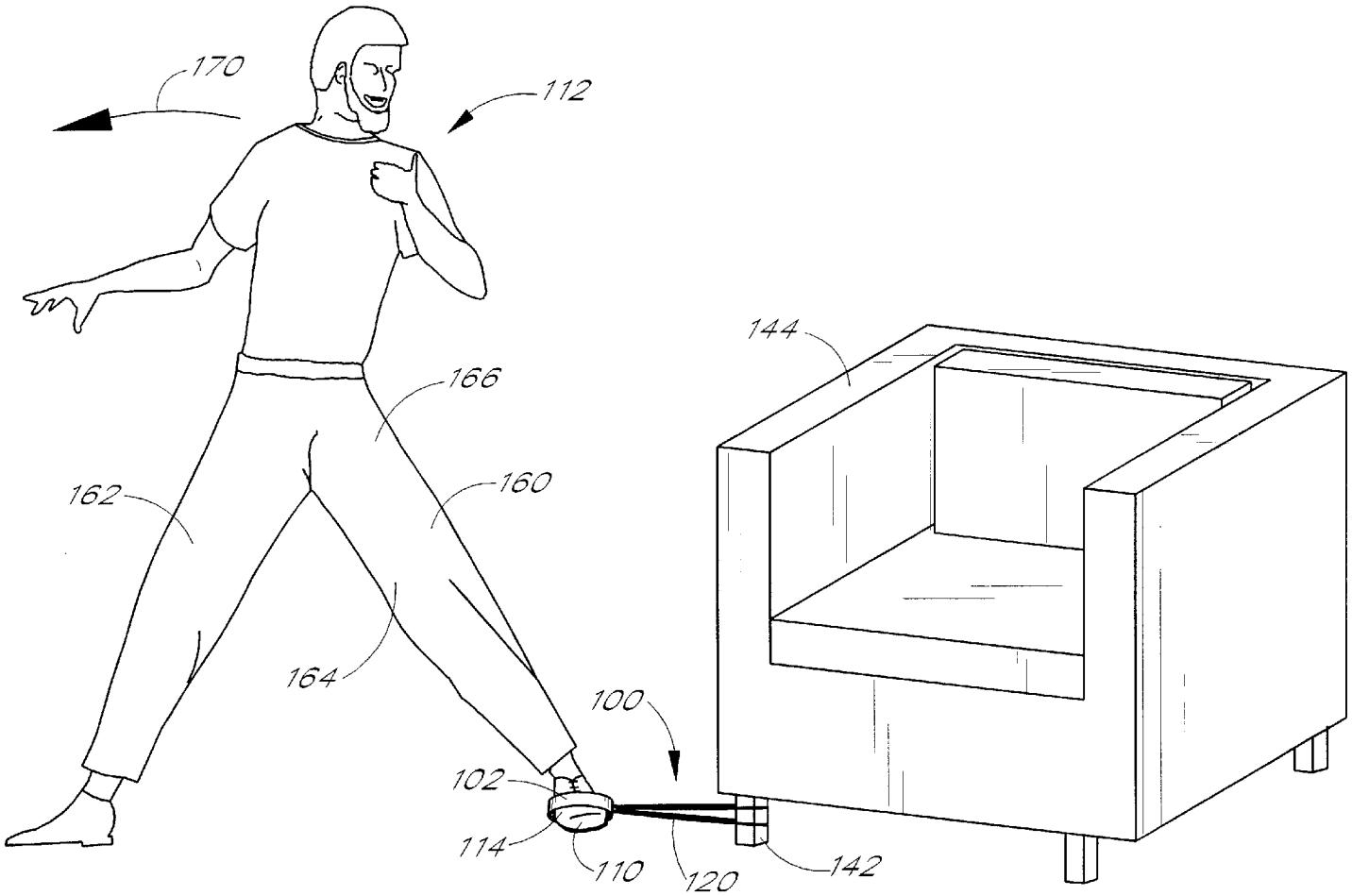
FIG. 1 illustrates the apparatus and method of the present invention in use by a person wherein the apparatus is anchored at one end to a heavy article of furniture and the person's foot is inserted in the stirrup at the opposite end of the apparatus.
Figure 2:
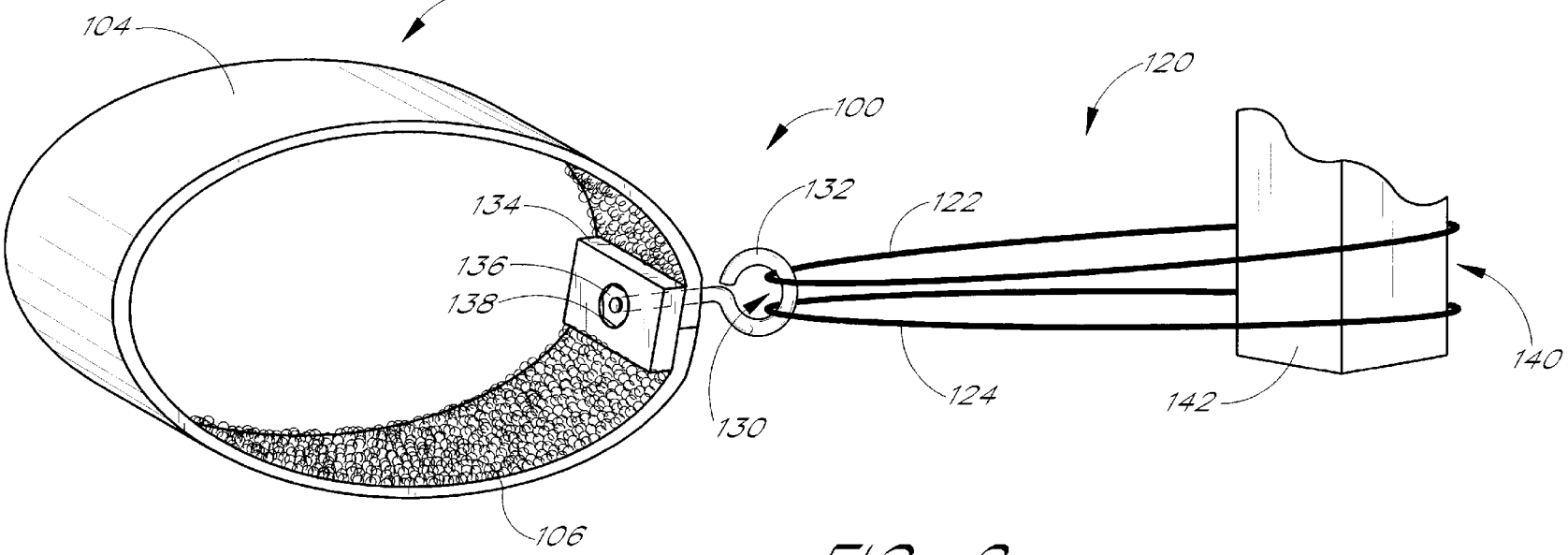
FIG. 2 illustrates one embodiment of the apparatus of the present invention in more detail showing the pliable structure of the stirrup portion and the generally inelastic interconnections to the leg of an article of furniture serving as an anchor.

FIGS. 1 and 2 illustrate a preferred embodiment of an apparatus 100 in accordance with the present invention. The apparatus 100 includes a cuff 102 which comprises pliable outer material 104 which is lined with cushioned inner liner 106. In an exemplary embodiment, the cuff 102 is advantageously constructed from readily available carpet material configured as a short tube wherein the cloth backing of the carpet material is positioned on the outside of the tube as the outer material 104 and the carpet pile is positioned on the insider of the tube as the cushioned inner liner 106.

Although described above in connection with a particular cuff materials, the present invention can be readily implemented using other flexible materials such as leather, plastic, or the like.

The tube forming the cuff 102 has a generally circular inside dimension which assumes a generally oval shape when in use. The inside dimension of the tube is sized to receive an adult foot 110 of a person 112. Preferably, the inside dimension is of adequate size to receive the foot 104 even when a shoe 114 is on the foot 110, as shown in FIG. 1. For example, when formed as a circle, the cuff 102 advantageously has a inside diameter of approximately four inches. The cuff 102 can, have a larger diameter for a larger foot and can have a smaller diameter for a smaller foot.

The length of the tube of the cuff 102 is selected to be shorter than the distance from the toe of the foot 110 to the instep or ankle of the foot 110 so that when the person 112 places his or her foot 110 into one end of the cuff 102 up to the instep of the foot 110, the toe of the foot 110 (or shoe 114) extends from the opposite end of the cuff 102. For example, in one embodiment, the length of the tube of the cuff 102 is approximately 2 inches.

The cuff 102 is attached to an interconnecting medium 120, which, in the illustrated embodiment, is a substantially inelastic cord 122. For example, the interconnecting medium 120 advantageously comprises a nylon cord 122 or other similar material. Preferably, a second inelastic nylon cord 124 is also included to provide additional safety, as will be discussed below. Each of the cords 122, 124 is formed into a respective loop by knotting the free ends of the cords with a non-slip knot (not shown). In the preferred embodiment, the cords 122, 124 have lengths of approximately 20 inches to provide an interconnection length of approximately 10 inches when formed in respective loops.

In the illustrated embodiment, the interconnecting medium 120 is attached at a first end 130 to the cuff 102 via an eyebolt 132 which passes through a hole in the outer material 104 and enters a corresponding hole in a retaining block 134 on the inner surface 106 of the cuff 102. A nut 136 in a recess 138 in the retaining block 134 engages the threads of the eyebolt so that the eyebolt 132 is fixed to the retaining block 134. In the embodiment illustrated herein, the retaining block 134 comprises wood, and the outer material 104 is fixed to the retaining block 134 by staples (not shown) or by other suitable fastening devices. In this manner, the tubular shape of the cuff 102 is also fixed because the retaining block 134 effectively closes the outer circumference of the cuff 102 to form the tubular shape.

As illustrated, a second end 140 of the interconnecting medium 120 is connected to a leg 142 of a heavy article of furniture 144 or to another substantially stationary object. As illustrated in FIG. 2, the second end 140 of the interconnecting medium 120 comprises loops in the cords 122, 124 which encircle the leg 142, as shown. The article of furniture 144 may be, for example, a large easy chair, as shown, a love seat or a coach, having a mass sufficient to preclude the furniture from moving when the apparatus 100 is used in accordance with the method described below. It should be understood that the furniture does not have to be excessively massive because the force applied in accordance with the method of the invention (described below) is not intended to exercise the muscles. Furthermore, typically the furniture will be sitting on carpet such that a substantial amount of friction assists in maintaining the furniture in a fixed location.

Figure 3:
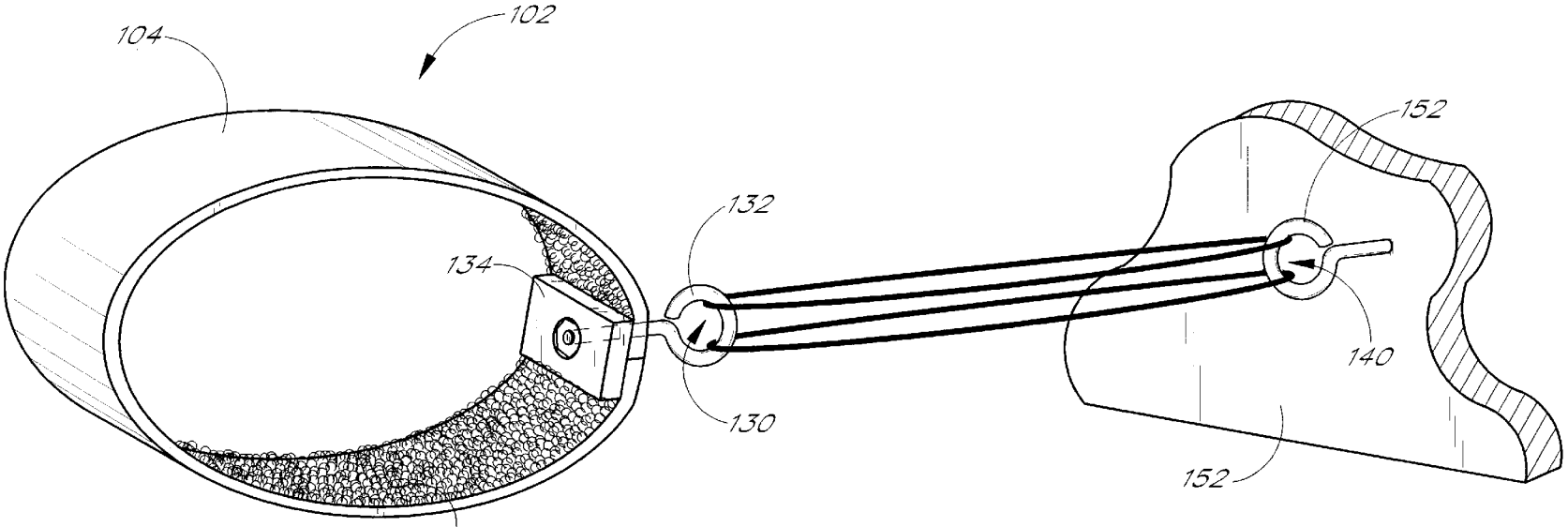
FIG. 3 illustrates an alternative method of using the present invention in which the inelastic interconnections are anchored to a fixed structure such as, for example, a wall.

If a substantially stationary article of furniture is not available or is not in a convenient location for use in accordance with the method described below, the second end 140 of the interconnecting medium 120 can be advantageously connected to a second eyebolt 150 (e.g., an eyebolt having a self-tapping screw end) mounted to a structure 152, such as, for example, a wall as shown in FIG. 3. Alternatively, the second eyebolt 150 can be attached to a post or the like. The second end 140 can be fixed to the second eyebolt 150 as shown in FIG. 3, or, in the alternative, the, second end 140 can advantageously include an S-hook (not shown) or other suitable device so that the second end 140 can be readily attached to and removed from the second eyebolt 150.

In accordance with the method of the present invention, the person 112 inserts the foot 110 of the leg 160 to be treated into the cuff 102 of the apparatus 100. As discussed above, the interconnecting medium 108 of the apparatus 100 is attached to the leg 142 (FIGS. 1 and 2) or to the structure 150 (FIG. 3) so that the cuff 102 is constrained a fixed distance from the leg 142 or the structure 150. The person 112 leans away from the article of furniture 144 (or the wall 152 in FIG. 3) in a direction generally indicated by an arrow 170 while supporting most of his or her body weight on the free leg 162. At the same time, the person 112 relaxes the muscles in the constrained leg 160 to the extent possible without losing the person's balance. This positioning of the body and distribution of the body weight causes the constrained foot 110 to be pulled in a direction away from the article of furniture 144 which is generally parallel to the floor on which the person is standing, although the foot 110 may raise a small distance above the floor. The weight of the stationary object 144 coupled through the apparatus 100 constrains the foot 110 from moving Away from the furniture 144. Thus, a constraining force is applied to the foot 110. The constraining force applied to the foot causes lateral forces to be applied to the knee 164 and the hip 166 of the person's leg 160 to thereby provide the therapeutic benefit sought by the person 112. The lateral forces can also be considered as bending moments applied to the knee 164 and the hip 166. As discussed above, the muscles of the leg 160 are relaxed such that the muscles and tendons do not absorb the applied force. Thus, the lateral forces or bending moments applied to the knee 164 and the hip 166 are similar to the forces applied by a therapist, a chiropractor, or the like, to a prone patient by lifting on the leg 160 in a chiropractic or therapeutic procedure.

After completing the above-described procedure on the knee and hip of the leg 160, the person 112, removes his or her foot 110 from the cuff 102, turns around, inserts the foot of the other leg 162 into the cuff 102, and repeats the procedure. The procedures can be completed on both legs 160, 162 in a very short amount of time and without assistance from another person.

Because force is applied against the foot 110 during the foregoing procedure, the inner liner 106 provides a cushioning effect to reduce the probability of bruising the inside of the foot 110. In addition, the pile lining in the preferred embodiment acts to reduce the probability that the foot 110 will slip out of the cuff 102. Note further that the retaining block 134 is pulled away from the outside of the foot 110 so that the foot 110 does not applied any pressure against the hard material of the retaining block 134.

Because the person 112 is generally in an off-balanced position when the foregoing procedure is performed, it is important that the apparatus 100 not release the person's foot 110 unexpectedly. Thus, in the preferred embodiment, the interconnecting medium includes the two cords 122, 124, either of which has sufficient strength to constrain the foot 110 from moving, so that if one cord should fail, the other cord will continue to constrain the foot.

This invention may be embodied in other specific forms without departing from the essential characteristics as described herein. The embodiments described above are to be considered in all respects as illustrative only and not restrictive in any manner. The scope of the invention is indicated by the following claims rather than by the foregoing description. Any and all changes which come within the meaning and range of equivalency of the claims are to be considered within their scope.

What is claimed is:

1. An apparatus for applying lateral force to the joints of a leg of a person standing on a generally level surface, comprising:

a generally inelastic interconnecting medium having a first end and a second end;

a cuff attached to the first end of the interconnecting medium and posititoned to initially rest on the generally level surface, the cuff sized to receive a portion of a foot of the leg to which the lateral force is to be applied, the cuff comprising a tubular member attached to a retaining block, the retaining block connecting the cuff to the first end of the interconnecting medium; and an engager at the second end of the interconnecting medium for attaching the interconnecting medium to a substantially stationary object such that when the person pulls on the foot in the cuff in a direction away from the substantially stationary object, the foot remains substantially in one location proximate to the generally level surface and lateral force is applied to the joint of the leg.

2. The apparatus as defined in claim 1, wherein the tubular member comprises a soft pliable material to distribute force over the surface of the foot directed away from the interconnecting medium.

3. The apparatus as defined in claim 2, wherein the tubular member comprises a cloth backing material with a cushioned inner liner.

4. The apparatus as defined in claim 1, wherein the interconnecting medium is a substantially inelastic cord and the engager comprises a loop formed in the cord.

5. The apparatus as defined in claim 1, wherein the stationary object comprises a heavy article of furniture.

6. The apparatus as defined claim 1, wherein the stationary object comprises a structure having a connector fixed thereto to attach to the interconnecting; medium.

7. The apparatus as defined claim 6, wherein said connector affixed to said structure comprises an eyebolt.

8. An apparatus for applying lateral force to the joints of a leg of a person standing on a generally level surface, comprising:

a cuff positioned to initially rest on a generally level surface and sized to received a portion of a person's foot between the toes of the foot and the ankle of the foot; and a block interconnecting the cuff to a generally inelastic medium, said medium composing means for interconnecting the block to a substantially stationary anchor such that when the foot of one leg of the person is placed in the cuff and the pulls away from the anchor, the foot is constrained from moving away from the anchor thereby applying lateral force to the knee and hip joint of the one leg.

9. The apparatus as defined in claim 8 wherein the cuff comprises a soft pliable material to distribute force over the surface of the foot directed away from the interconnecting medium.

10. The apparatus as defined in claim 9 wherein the cuff comprises a cloth backing material with a cushioned inner liner.

11. The apparatus as defined in claim 8, wherein the means for interconnecting comprises a substantially inelastic cord having a loop formed in at least one end to engage the anchor.

12. The apparatus as defined in claim 8, wherein the anchor comprises a heavy article of furniture.

13. The apparatus as defined claim 8, wherein the anchor comprises a structure a connector fixed thereto for attaching to the means for interconnecting.

14. The apparatus as defined claim 13, wherein said connector affixed to said structure comprises an eyebolt.

15. A method for applying lateral force to the joints of a leg of a person standing on a generally level surface, the method comprising the steps of:

inserting the foot of the leg into a cuff, said cuff comprising a tabular member attached to a retaining block, said retaining block attached to an interconnecting medium said medium anchored to a substantially stationary object at a level proximate to a surface on which the person is standing; and pulling on the foot in the cuff to cause a pulling force applied to the foot to be transmitted to the joints of the leg, thereby applying lateral force to the joints when the person is leaning in a direction away from the substantially stationary object.

16. The method as defined in claim 15, wherein the stationary object comprises a heavy article of furniture.

17. The method as defined claim 15, wherein the stationary object comprises a structure.

* * * * *

UNITED STATES PATENT AND TRADEMARK OFFICE

CERTIFICATE OF CORRECTION

PATENT NO. : 5,836,857
DATED : November 17, 1998
INVENTOR(S) : Fred C. Jennings

It is certified that error appears in the above-indentified patent and that said Letters Patent is hereby corrected as shown below:

In Claim 1 (column 5 at line 13), change "posititioned" to --positioned--.

In Claim 15 (column 6 at line 33), change "tabular" to --tubular--.

Signed and Sealed this

Sixteenth Day of November, 1999

*Attest:*

Q. TODD DICKINSON

*Attesting Officer*

*Acting Commissioner of Patents and Trademarks*